United States Patent [19]

Gersl

[11] 4,331,879

[45] May 25, 1982

[54] PHOTOELECTRIC DEVICE FOR SENSING THE HEIGHT OF A PILE OF PAPER SHEETS

[75] Inventor: Bozislav Gersl, Sadova, Czechoslovakia

[73] Assignee: Adamovske strojirny, narodni podnik, Czechoslovakia

[21] Appl. No.: 149,023

[22] Filed: May 12, 1980

[30] Foreign Application Priority Data

May 12, 1979 [CS] Czechoslovakia ..... 3250 79

[51] Int. Cl.[3] ..... G01N 21/30

[52] U.S. Cl. ..... 250/561; 250/222 R

[58] Field of Search ..... 250/527, 561, 222

[56] References Cited

U.S. PATENT DOCUMENTS 3,388,258 6/1968 Grant ..... 250/577

4,229,650 10/1980 Takahashi et al. ..... 250/561

*Primary Examiner*—David C. Nelms

*Assistant Examiner*—Darwin R. Hostetter

*Attorney, Agent, or Firm*—Burgess, Ryan and Wayne

[57] ABSTRACT

The invention is a photoelectric sensing device, in the body of which is rotatably mounted a photoelectric sensing element, the sight opening of which is arranged in a plane with the front stops and bears on the vertical front plane of the pile of paper sheets. The body of the photoelectric sensing device can be mounted on the carrier rod of the front stops. The sensing device provides an advantage in that the device works with daylight and also with artificial light so that a special source of light is not necessary for operation of the sensing device. As a result of arranging the photoelectric sensing element in the plane of the front or lateral stops, the sight opening glass is continually wiped by falling paper sheets and is not obscured by dust. The photoelectric sensing device is simple to manufacture and is reliable.

12 Claims, 4 Drawing Figures

PHOTOELECTRIC DEVICE FOR SENSING THE HEIGHT OF A PILE OF PAPER SHEETS

The invention relates to a photoelectric device for sensing the height of a pile of paper sheets on a delivery table of a printing machine.

The object of the invention is to provide a photoelectric device for sensing the height of a pile of paper sheets on a delivery table, where the height of the delivery table is controlled by the device and lowered during the printing operation in such a way, that the top of the pile of sheets remains at a constant height.

One of the known devices for the control of the level of a pile of paper sheets on a delivery table of a printing machine comprises a microswitch feeler device which is arranged on a rigid or on a movable aligning element for the pile of sheets. When the height of the pile of sheets increases, a microswitch is activated and provides a signal to a further mechanism which controls the lowering of the delivery table with the pile of paper sheets.

A disadvantage of this device is that a power supply is necessary for the control of the feeler device which results in difficulties when thin paper sheets with a weight of about 20–40 g/m$^2$ are printed, because these paper sheets are often creased particularly at the beginning of the printing process.

Another known device for the control of the height of a pile of paper sheets comprises a reflection receiving photoelectric sensing element. This photoelectric sensing device is activated by the light of an electric bulb reflected from the pile of paper sheets which falls on a sensing element comprising a phototransistor or a photodiode. By means of circuits connected to the sensing element, the delivery table with the pile of paper sheets is lowered as the height of the pile of paper sheets increases.

A disadvantage of this device is coating of the sensing element with dust which results in failure of the operation of the device. Most types of offset sheet printing machines use devices for providing the printed sheets with a coating of fine powder to improve drying. The powder coats the sensing element and also reduces the life of the electric bulb source of the reflected light beam.

Another known device for the control of the height of a pile of paper sheets is a capacitor sensing device. This device works on the capacitance principle where the pile of paper sheets located on the delivery table comprises the dielectric. These capacitor feeler devices are highly reliable in operation and from a technical point of view, the most advantageous sensing devices.

The capacitor sensing device is expensive to manufacture which eliminates the use of such devices on lower price printing machines, particularly on printing machines for smaller sheet sizes. Also, the repair of capacitor sensing devices is complex and requires the servicing by an electronic specialist.

The above-mentioned disadvantages are avoided by a photoelectric sensing device for the control of the height of a pile of paper sheets of the present invention. According to the present invention, in a body of a photoelectric sensing device, is turnably arranged a support element on which is eccentrically arranged a photoelectric element, the sight opening of which is arranged so that it can be located in the plane of the front or lateral stops and bears on a vertical plane of the pile of paper sheets. The body of the photoelectric sensing element can be mounted on a carrier rod of the stops. The photoelectric element is eccentrically mounted on a turnable element in the body of the photoelectric sensing device. The sight opening of the photoelectric sensing element is located in the plane of the front stops or the lateral stops and bears on the pile of sheets. The sight opening of the photoelectric element is located in the plane of the stops and bears on the side of the pile of sheets. The sight opening is covered by a light transmitting material which protects the photoelectric element. The photoelectric element is provided with connectors for connection with means which adjust the vertical position of the delivery table in response to the signal from the photoelectric element.

An advantage of the device of the present invention is in that the photoelectric sensing device works with artificial light sources or with natural light from the environs so that a special source of light is not required. The photoelectric sensing device can be arranged in the plane of the front or lateral stops of the delivery device where the sight opening of its photoelectric element is continually contacted by the falling delivered paper sheets so that coating of the photoelectric sensing element with dust is not possible.

Further advantages of the photoelectric device of the present invention are in the simple structure, low manufacturing costs and reliable operation of the device.

The invention will now be described, by way of example, with reference to the accompanying drawings, wherein.

Figure 1:
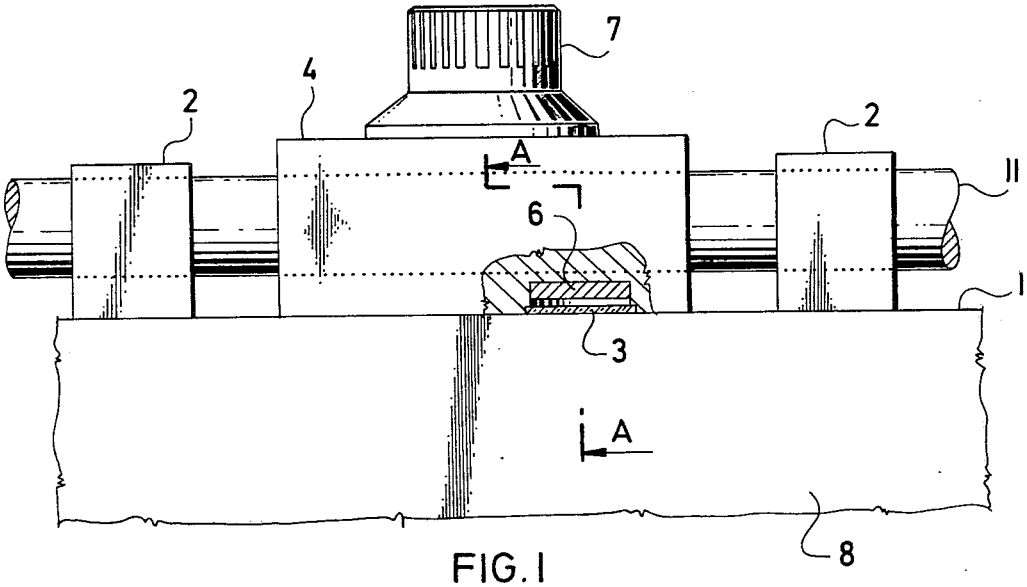
FIG. 1 illustrates a top view of the photoelectric sensing device.
Figure 2:
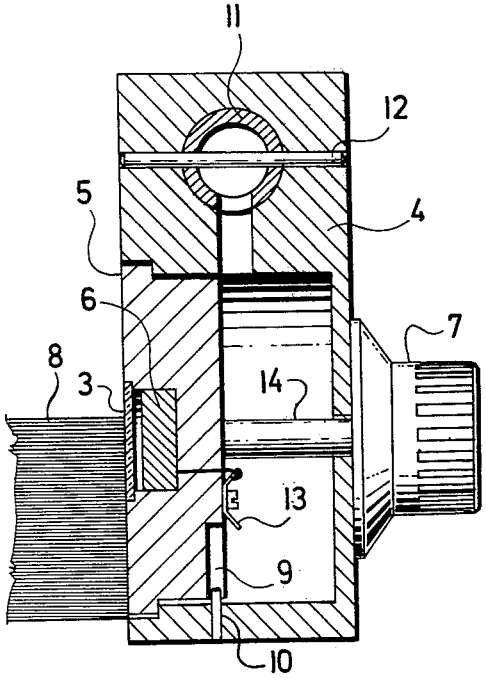
FIG. 2 is a side view of a partial section in the plane A—A of the device of FIG. 1.
Figure 3:
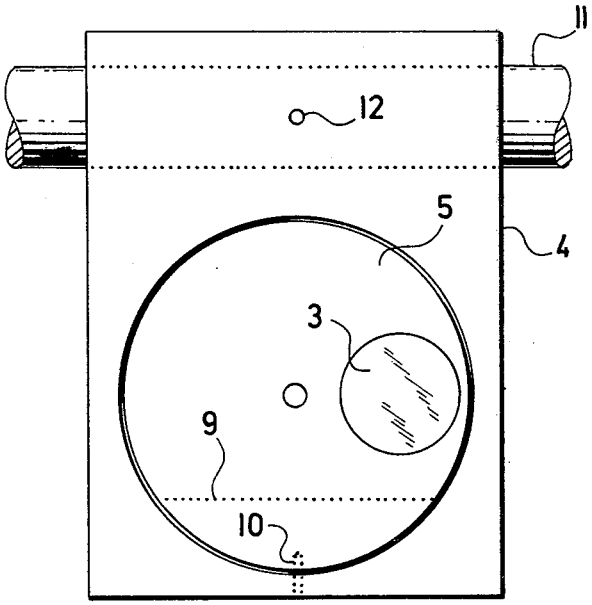
FIG. 3 is a view of the device according to FIG. 2 in a direction of arrow P.
Figure 4:
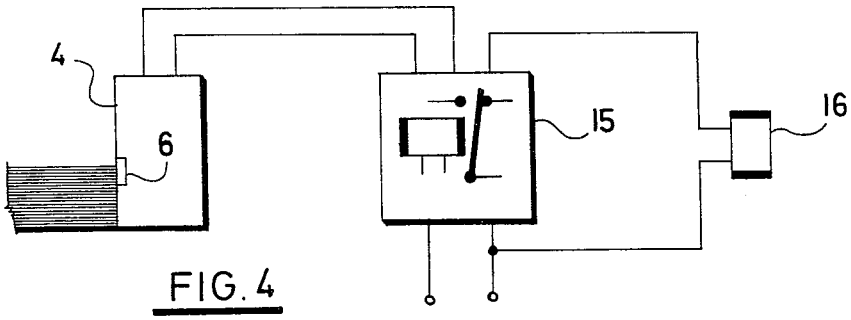
FIG. 4 illustrates a schematic of the electric connection of the photoelectric sensing device.

The photoelectric sensing device for sensing the height of a pile of paper sheets according to the invention consists of a body 4, in which is turnably mounted support element 5 which can rotate over a portion of a circle on which is eccentrically attached a photoelectric element 6. The photoelectric element 6 can be a diode, a photoresistor or a phototransistor. The photoelectric element 6 is provided with a light transmitting sight opening 3, which can be made from glass, transparent inorganic crystals or transparent organic polymers.

The turnable element 5 is rigidly connected with a shaft 14 which is provided with a control knob 7. The turnable element 5 is provided with a cut out 9, which engages a pin 10 which is fixed in the body 4 of the photoelectric sensing device. The terminals of the photoelectric element 6 are attached to connectors 13 provided on the turnable element 5. The body 4 of the photoelectric sensing device is mounted on a carrier rod 11 and is secured by a securing element 12. The carrier rod 11 is turnably mounted on the side walls of the printing machine. The stacking surfaces 20 of front stops 2, the sight opening 3 of the photoelectric element 6 and the vertical front plane of the pile 8 of sheets are in a common plane 1. An alternatively arranged device has the sight opening 3 of the photoelectric element 6 arranged in the plane of the lateral stop elements of the delivery table so that it bears on the side of the pile 8 of paper sheets in its vertical lateral plane. The photoelectric element 6 can be mounted either on the front stop 2 or on the lateral stop element which is not illustrated in the drawings.

The photoelectric element 6 can be rigidly mounted on the body 4 (not shown). When the photoelectric element is rigidly mounted in the body, the position of the body must be changed to adjust the height of the pile of paper sheets.

The photoelectric sensing device works as follows:

When a pile 8 of paper sheets is set up on the delivery table by delivered printed sheets and the pile 8 reaches a height, where sufficient light cannot enter the sight opening 3 and fall on the photoelectric element 6 of the photoelectric sensing device, the photoelectric element 6 gives, via an electronic relay 15 and an electromagnet 16, an impulse for lowering the delivery table until the pile 8 of sheets reaches the required level.

By means of control knob 7, the rotatable element 5 can be turned together with the photoelectric element 6 through an angle about 120°. Since the photoelectric element 6 is eccentrically mounted on rotatable element 5, the photoelectric element 6 is shifted in a vertical direction relative to the top of the pile 8 of sheets from the mean position. Usually a vertical shift of about ±15 mm is suitable. The shifting of the photoelectric element 6 is advantageous as it enables the adjustment of the means values of the height and top level of the pile of paper sheets.

The limits for the rotation of the turnable element 5 are set by the cut out 9 which is provided in the element 5, which is engaged by the pin 10 fixed in the body 4 of the photoelectric sensing device.

The photoelectric sensing device according to the invention can be used where automatic control of constant height and top level of a pile of paper sheets is needed.

What is claimed is:

1. A photoelectric device for sensing the height of a pile of paper sheets on a delivery table, movable in the vertical direction, of a printing machine which comprises: a body, a photoelectric element having connectors and provided with a light transmitting sight opening, said photoelectric element being rigidly mounted in said body wherein said light transmitting opening of said photoelectric element is arranged to bear against a side of the pile of paper sheets.

2. A photoelectric device for sensing the height of a pile of paper sheets on the delivery table, movable in the vertical direction, of a printing machine which comprises: a body, a support turnably mounted in said body, on which is eccentrically arranged a photoelectric element having connectors and provided with a light transmitting sight opening, said body being arranged so that the light transmitting sight opening of the photoelectric element is arranged to bear against a side of the pile of paper sheets.

3. The device of claim 1 or 2 wherein the body of the device is arranged in communication with at least one front stop element so that the sight opening of the photoelectric element is in the plane of the stacking surface of the front stopping element.

4. The device of claim 3 wherein the body of the device is mounted on the front stopping element.

5. The device of claim 3, wherein the device is mounted on a carrier rod of the front stopping elements and the sight opening of the photoelectric element bears against the vertical front plane of the pile of paper sheets.

6. The device of claim 1 or 2 wherein the body of the device is arranged in communication with at least one lateral stoping element so that the sight opening of the photoelectric element is in the plane of the stacking surfaces of the lateral stopping elements.

7. The device of claim 6 wherein the body of the device is mounted on the lateral stopping elements.

8. The device of claim 6 wherein the body of the device is mounted on the lateral stopping elements and the sight opening of the photoelectric element bears against the vertical lateral plane of the pile of sheets.

9. The device of claim 1 or 2 wherein the photoelectric element is in communication with means for adjusting the vertical position of said delivery table in response to a signal from the photoelectric element.

10. The device of claim 3 wherein the photoelectric element is in communication with means for adjusting the vertical position of said delivery table in response to a signal from said photoelectric element.

11. The device of claim 1 or 2 wherein the photoelectric element is a diode, a photoresistor or a phototransistor.

12. The device of claim 2 having means for limiting the angle through which the turntable support can be turned.

* * * * *